US007896690B1

(12) United States Patent
Hsu et al.

(10) Patent No.: US 7,896,690 B1
(45) Date of Patent: Mar. 1, 2011

(54) ELECTRICAL CONNECTION DEVICE

(75) Inventors: Cheng-Chieh Hsu, Taipei (TW); Chung-Ping Feng, Taipei (TW)

(73) Assignee: Edison Opto Corporation, Taipei (TW)

( * ) Notice: Subject to any disclaimer, the term of this patent is extended or adjusted under 35 U.S.C. 154(b) by 0 days.

(21) Appl. No.: 12/889,413

(22) Filed: Sep. 24, 2010

(51) Int. Cl.
*H01R 11/00* (2006.01)

(52) U.S. Cl. ..... 439/502; 439/271; 439/298

(58) Field of Classification Search ..... 439/271, 439/498, 502
See application file for complete search history.

(56) References Cited

U.S. PATENT DOCUMENTS 3,667,101 A * 6/1972 Kloth ..... 29/749
5,007,856 A * 4/1991 Puerner ..... 439/452
6,165,009 A * 12/2000 Anbo et al. ..... 439/498
6,336,826 B1 * 1/2002 Kraft ..... 439/498

* cited by examiner

*Primary Examiner*—James Harvey
(74) *Attorney, Agent, or Firm*—CKC & Partners Co., Ltd.

(57) ABSTRACT

Disclosed herein is an electrical connector, which includes a first base, a second base and a cover. The first base includes a first recess and a first conductor. The first recess is positioned on an upper surface of the first base. The first conductor extends into the first recess through a lateral surface of the first base. The second base, has a structure similar to the first base, and includes a second recess and a second conductor. The cover includes a body, a first convex ring, a second convex ring and a metallic connector. When the cover engages with both the first and second bases, the first and second convex rings respectively engages with the first and second recesses, and thus forming two enclosed space.

19 Claims, 6 Drawing Sheets

ELECTRICAL CONNECTION DEVICE

BACKGROUND

1. Field of Invention

The present invention relates to an electrical connection device.

2. Description of Related Art

Electrical connection devices, which are provided for the electrical connection between two electrical devices or cables, have been widely used. For the purpose of electrical connection, conductive lines are arranged in the electrical connection device, and the conductive lines should be firmly connected to the devices or cables.

Usually, electrical connection devices may be divided into two different types, i.e. the indoor connector and the outdoor connector. Waterproof effect is required for an outdoor connector so as to prevent imperfect contact or electrical short caused by the leakage of water into the connector. In the prior art, an elastic sleeve is employed to surround the connector to prevent water from leakage into the connector. However, this type of outdoor connectors has problems in complicated procedure of assembly. On the other hand, waterproof effect is not required for indoor connectors, which are advantageous in quick assembly and convenient usage.

Some electrical devices such as LED lighting apparatus may be installed indoors or outdoors. The electrical connector for these devices needs both requirements of quick assembly and waterproof effect. Therefore, there exists in this art a need of improved electrical connectors that would meet these requirements.

SUMMARY

According to one aspect of the present disclosure, an electrical connection device is provided. The electrical connection device includes a first base, a second base and a cover. The first base includes a first top surface, a first lateral surface, a first recess and a first conductor. The first recess is located on the first top surface. The first conductor extends into the first recess from a position out of the first base through the first lateral surface. The second base includes a second top surface, a second lateral surface, a second recess and a second conductor. The second recess is located on the second top surface. The second conductor extends into the second recess from a position out of the second base through the second lateral surface. The cover is for covering the first and second bases. The cover includes a body, a first convex ring, a second convex ring and a first metallic connector. The body has a bottom surface. Both the first and second convex rings are positioned on the bottom surface. The first metallic connector is embodied in the body and having a first and a second terminal protruding from the bottom surface, wherein the first and second terminals are respectively positioned in the first and second convex rings. When the cover covers the first and second bases, the first and second convex rings respectively engages with the first and second recesses so that a first and a second enclosed space are formed, and the first and second terminals respectively connect to the first and second conductors.

According to another aspect of the present disclosure, the electrical connection device includes a base, a cover and a wire. The base includes a recess and a conductor. The recess is located on a top surface of the base. The conductor extends into the recess through the lateral surface from a position out of the base. The cover includes a convex ring and a metallic connector. The convex ring is positioned on a bottom surface of the cover. The metallic connector is embodied in the cover. The metallic connector has a first terminal protruding from the bottom surface. The first terminal is positioned in the convex ring. The wire extends into the cover through a lateral surface of the cover and is electrically coupled to the metallic connector. When the cover engages with the base, the convex ring engages with the recess so that an enclosed space is formed, and the first terminal of the metallic connector connects to the conductor According to one embodiment of the present disclosure, the electrical connection device provides a waterproof effect and is advantageous in quick assembly.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
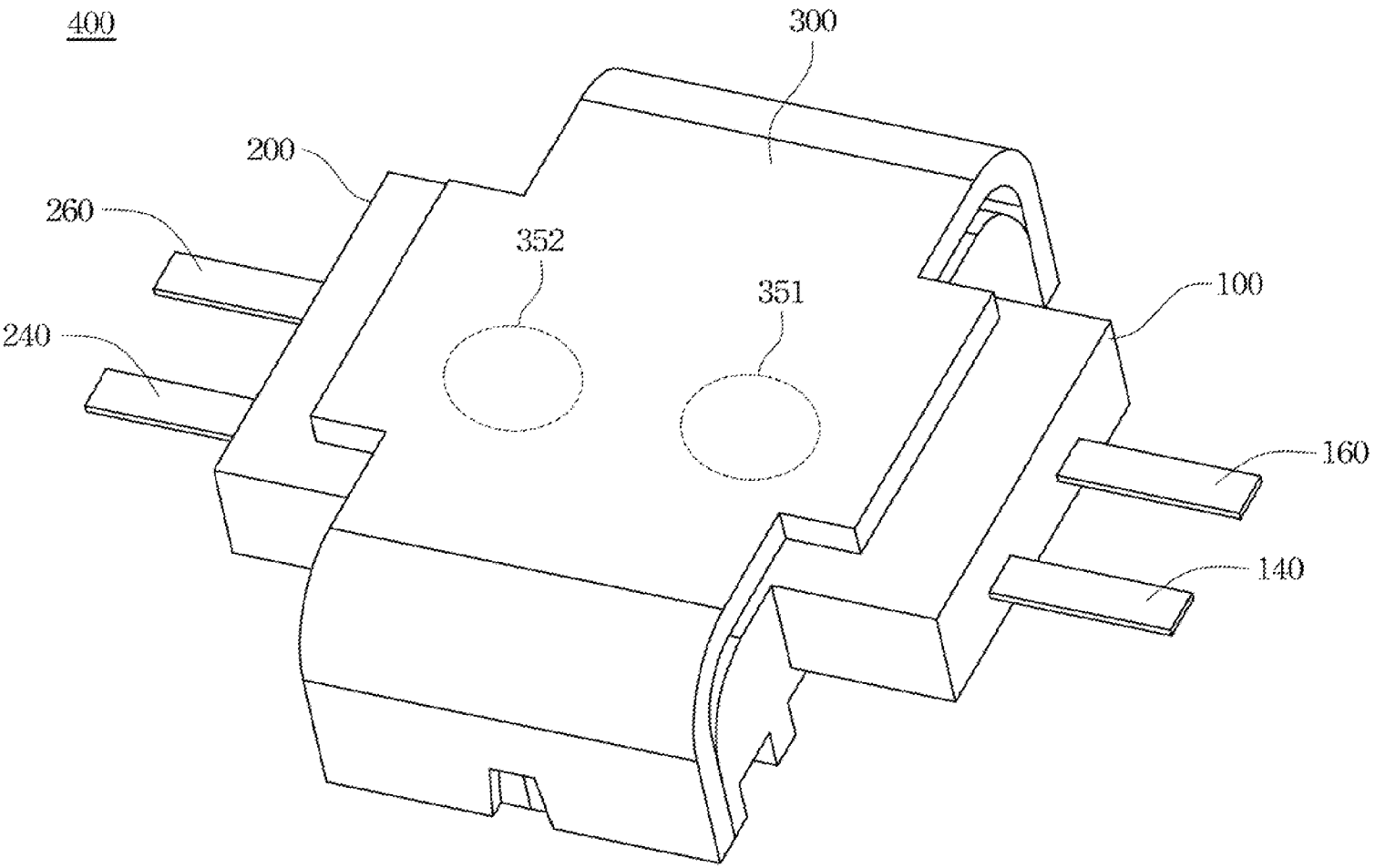
FIG. 1 is a perspective view schematically illustrating an electrical connection device according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 2:
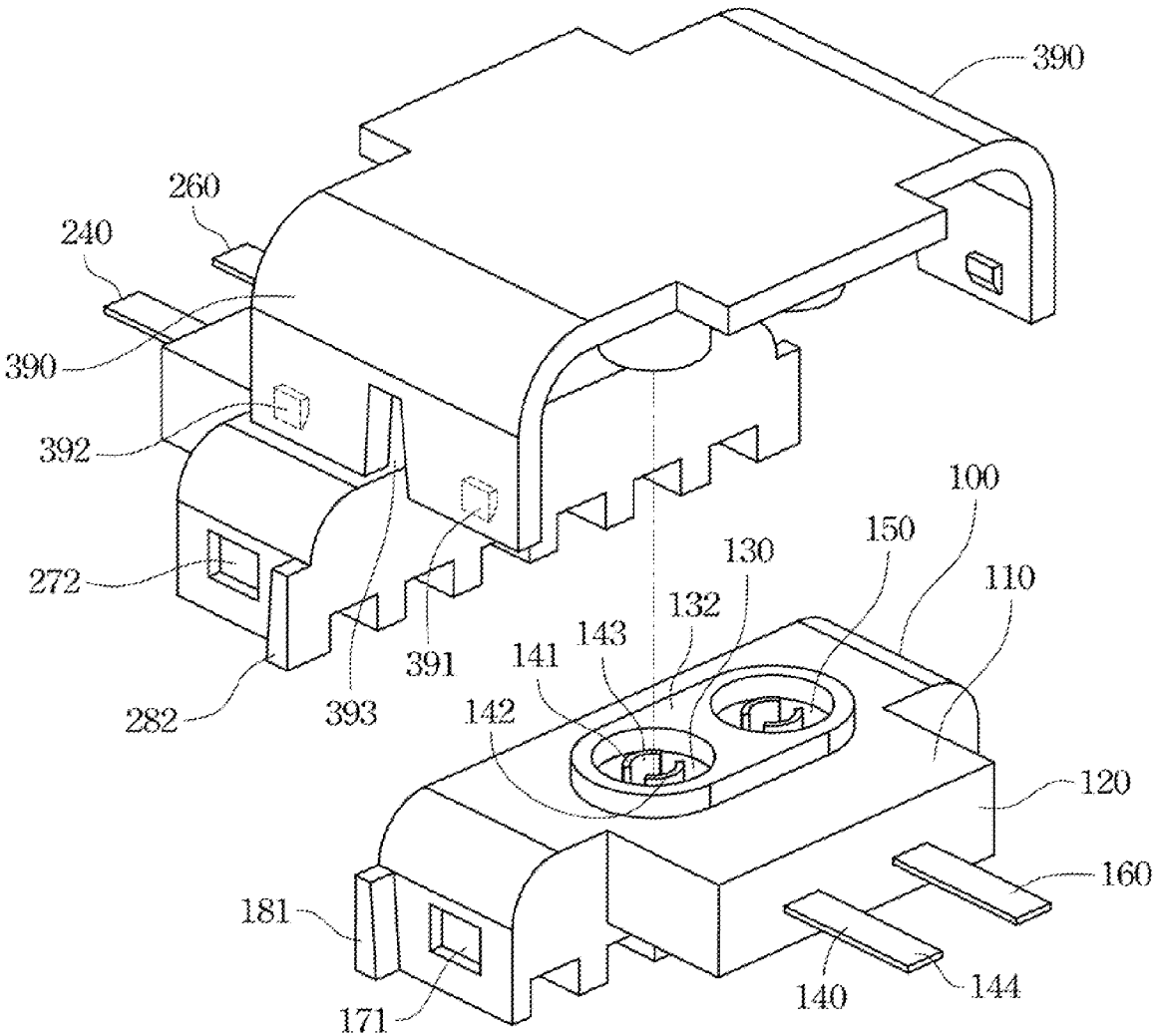
FIG. 2 and FIG. 3 are breakdown drawings schematically illustrating the electrical connection device in FIG. 1 from different viewing angles.
Figure 3:
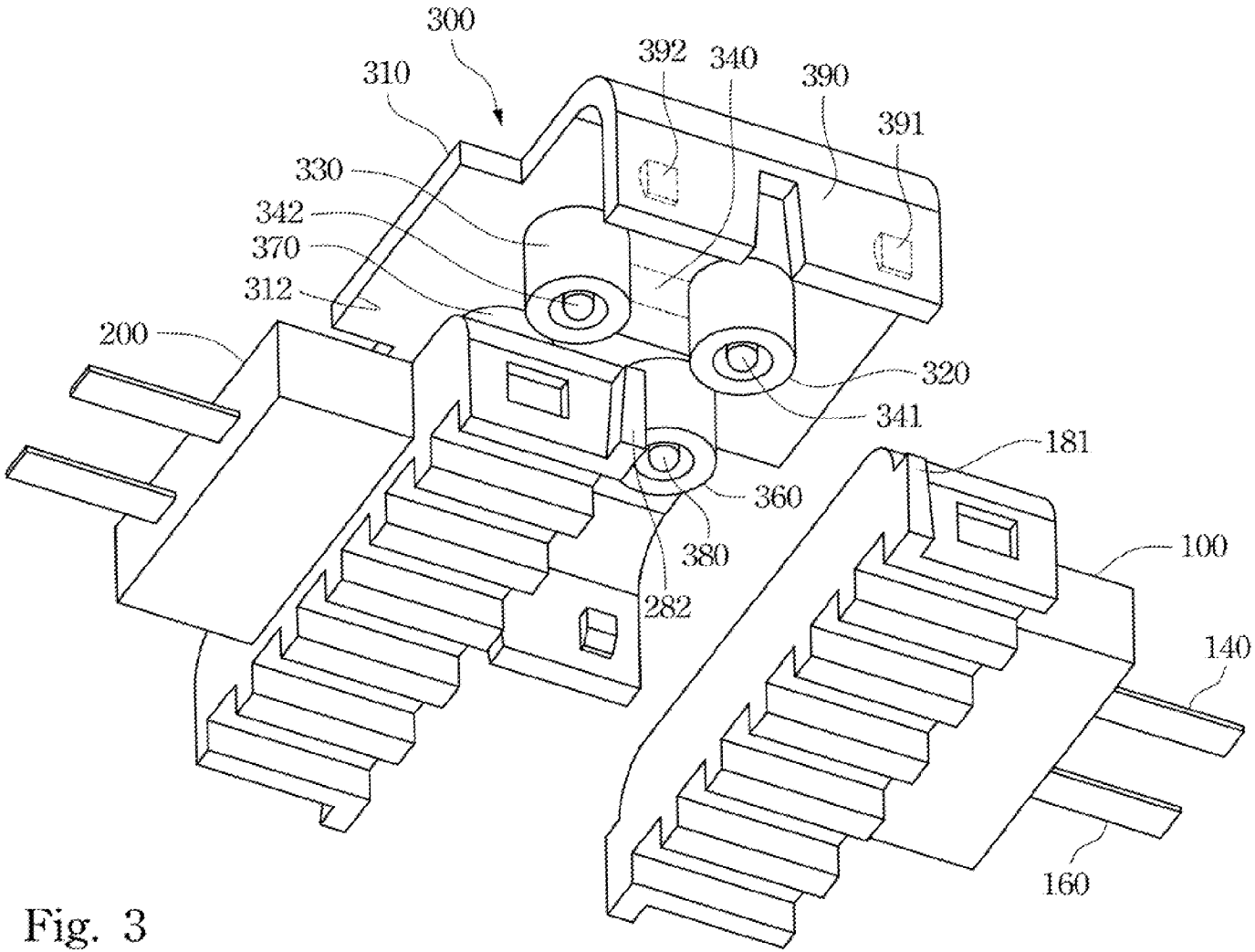
Figure 4:
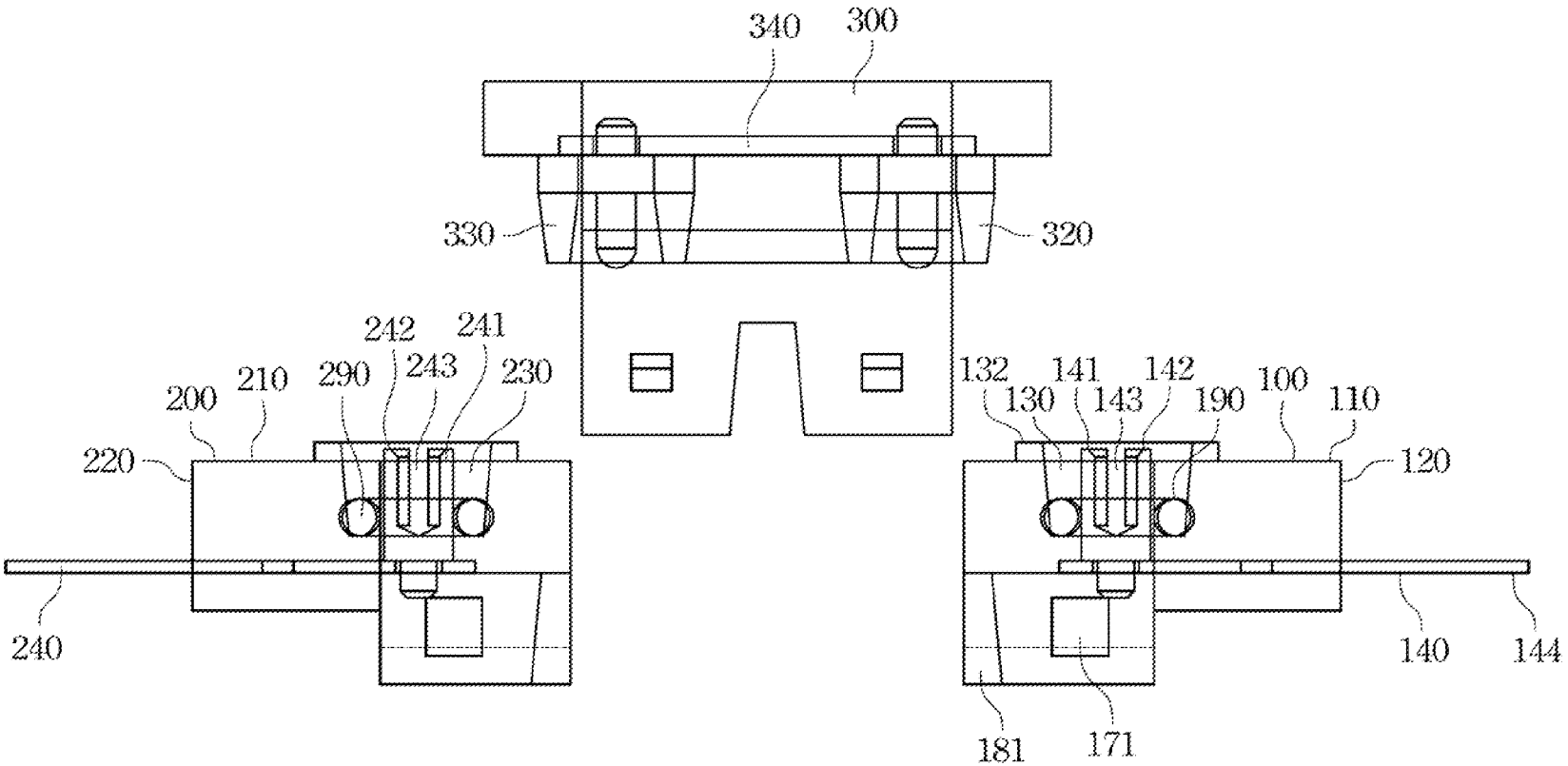
FIG. 4 is a side view schematically illustrating the electrical connection device in FIG. 1.

FIG. 1 is a perspective view schematically illustrating an electrical connection device 400 according to one embodiment of the present disclosure. FIG. 2 and FIG. 3 are breakdown drawings schematically illustrating the electrical connection device 400 in FIG. 1 from two different viewpoints. FIG. 4 is a side view schematically illustrating the electrical connection device 400. With reference to FIG. 1, the electrical connection device 400 comprises a first base 100, a second base 200 and a cover 300. The cover 300 provides an electrical connection between the first base 100 and the second base 200, and allowing the electrical connection device 400 to possess waterproof and airtight effects. The electrical connection device is described in detail in embodiments hereinafter.

With reference to FIG. 2 and FIG. 3, the first base 100 has a first top surface 110 and a first lateral surface 120, and comprises a first recess 130 and a first conductor 140. The first recess 130 is located on the first top surface 110. The first conductor 140 extends into the first recess 130 from a position out of the first base 100 through the first lateral surface 120.

In one embodiment, the first recess 130 may be a circular recess with a circular inlet, square recess with a square inlet or others. It is to be noted that the first recess 130 may not penetrate the first base 100. In one example, the first top surface 110 is formed thereon with a flange 132 which surrounds the inlet of the first recess 130, as depicted in FIG. 2.

The first conductor 140 is capable of transmitting an electrical current or a voltage signal into the first recess 130 from the exterior of the first base 100. The first conductor 140 may be fabricated as a unitary part or be composed of several individual parts. In one embodiment, the first conductor 140 has a portion protruding from the first lateral surface 120 and thus forming a metallic terminal 144 for connecting or soldering to an external electronics (not shown) such as a light ribbon composed of light emitting diodes (also refers to "LED light ribbon"). The length, width and thickness of the metallic terminal 144 is non-limited so long as it may provide enough dimension for connection or soldering, and thus providing a desired electrical connection.

In one embodiment, the first conductor 140 comprises a first metallic piece 141 and a second metallic piece 142 extending into the first recess 130, and a space 143 is formed between the first and second metallic pieces 141, 142. In one example, the first and second metallic pieces 141, 142 are curved metallic pieces, and a cylinder space 143 is formed therebetween, as depicted in FIG. 2. Both the first and second metallic pieces 141, 142 are operable to connect to the first metallic connector 340 of the cover 300 (described in detail hereinafter). Therefore, the first and second metallic pieces 141, 142 may be designed as different shapes or size according to the demand. In another example, the portion, such as the first and second metallic piece 141, 142 of the first conductor 140 in the first recess 130, does not exceed the top surface of the flange 132.

With reference to FIG. 2, in one embodiment, the first base 100 further comprises a third recess 150 and a third conductor 160. The third recess 150 is located on the first top surface 110 beside the first recess 130. The third conductor 160 extends into the third recess 150 through the first lateral surface 120 from a position out of the first base 100. In one example, the third conductor 160 has a structure the same as the first conductor 140 and is arranged in substantial parallel with the first conductor 140. Although FIG. 2 and FIG. 3 illustrates that the third conductor 160 is in parallel with the first conductor 140, person skilled in the art, however, may realize that the third conductor 160 may be arranged not in parallel with the first conductor 140 and the third conductor 160 may has a different structure from the first conductor 140. In examples, the first conductor 140 and third conductor 160 may respectively connect to different electrical signal. For example, the first conductor 140 may couple to a cathode while the third conductor 160 may couple to an anode. Alternatively, the first conductor 140 may couple to an anode whereas the third conductor 160 couples to a cathode.

With reference to FIG. 4, the second base 200 has a second top surface 210 and a second lateral surface 220, and comprises a second recess 230 and a second conductor 240. The second recess 230 is positioned on the second top surface 210. The second conductor 240 extends into the second recess from a position out of the second base 200 through the second lateral surface 220. The structure of the second base 200 may be the same as or different from the first base 100. In one example, the second base 200 is the same as the first base 100 for the purpose of convenience in materials management. In another example, the second base 200 and the first base 100 are mirror-symmetric with respect to each other. In other example, the second base 200 has a different structure from the first base 100.

The second conductor 240 is operable to transmit an electrical current or a voltage signal into the second recess 230 from the exterior of the second base 200. The second conductor 240 may be the same as or different from the first conductor 140 in structure. In one example, the second conductor 240 comprises a third metallic piece 241 and a fourth metallic piece 242 extending into the second recess 230, and a space 243 is formed between the third and fourth metallic pieces 241, 242. In another example, both the third and fourth metallic pieces 241, 242 are curved metallic pieces, and a cylinder space is formed therebetween. The third and fourth metallic pieces 241, 242 serves as a connecting structure, and therefore may be designed as different shapes or size according to the demand.

In one example, the second base 200 further comprises a fourth recess and a fourth conductor 260. The structure and the arrangement of the fourth recess and the fourth conductor 260 may be similar with the third recess 150 and the third conductor 160, respectively. In particular, the fourth recess and the fourth conductor 260 are mirror-symmetric with the third recess 150 and the third conductor 160. In this example, the second conductor 240 may electrically couple to the first conductor 140, and the fourth conductor 260 may electrically couple to the third conductor 160.

With reference to FIG. 3 and FIG. 4, the cover 300 is operable to connect the first base 100 with the second base 200 and also cover the first and second bases 100, 200. The cover 300 comprises a body 310, a first convex ring 320, a second convex ring 330 and a first metallic connector 340. The body 310 has a bottom surface 312. The first convex ring 320 and second convex ring 330 are disposed on and protrude from the bottom surface 312 of the body 310. The first metallic connector 340 is substantially embodied in the body 310, and has a first terminal 341 and a second terminal 342 protruding from the bottom surface 312. The first and second terminals 341, 342 are respectively positioned in the first and second convex rings 320, 330.

With reference to FIG. 1 and FIG. 2, when the cover 300 covers the first and second bases 100, 200, the first convex ring 320 engages with the first recess 130 of the first base 100, and forming a first enclosed space 351 which is surrounded by the first convex ring 320 and the first recess 130. Simultaneously, the first terminal 341 of the first metallic connector 340 connects to the first conductor 140 in the first recess 130. The second convex ring 330 engages with the second recess 230, and forming a second enclosed space 352. The second terminal 342 of the first metallic connector 340 connects to the second conductor 240 in the second recess 230. Therefore, the first conductor 140 of the first base 100 may be electrically coupled to the second conductor 240 of the second base 200 through the first metallic connector 340.

In one example, the first and second convex rings 320, 330 respectively engage with the first and second recess 130, 230. In particular, both the first and second convex rings 320, 330 are substantially circular convex rings, and both the first and second recesses 130, 230 are circular recess with circular inlets. The outer edges of the first and second convex rings 320, 330 respectively engage with the inner edge of the first and second recesses 130, 230. The first and second convex rings 320, 330 may respectively be contained in the first and second recesses 130, 230, and thus forming the first and second enclosed spaces 351, 352. Airtight effect and waterproof effect of the electrical connection device 400 may be obtained.

Although the first and second convex rings 320, 330 are disposed on the cover 300 while the first and second recesses 130, 230 are respectively located on the first and second bases 100, 200, as described hereinbefore, one skilled in the art, however, may realize that the locations of the convex rings and recesses may be mutually exchanged. Specifically, the convex ring(s) may be disposed on the first and/or second base(s) while the feature of the recess may be located on the cover, and whereby the enclosed space may be formed.

In another example, the first terminal 341 of the first metallic connector 340 may be inserted into the space 143 formed between the first and second metallic pieces 141, 142 of the first conductor 140 in the first recess 130. Specifically, the first and second metallic pieces 141, 142 may be constituted as two curved metallic pieces opposite to each other, and thus forming a cylinder space 143 therebetween. Furthermore, the first terminal 341 of the first metallic connector 340 may be shaped of a cylinder, and be inserted into the space 143, as depicted in FIG. 2 and FIG. 3. Therefore, the first terminal 341 of the first metallic connector 340 may be electrically coupled to the first conductor 140. By a similar way, the second terminal 342 of first metallic connector 340 may be connected to the second conductor 240 in the second recess 230. The above-mentioned features of connection are for the purpose of illustration, and the present disclosure is not limited thereto.

In another embodiment, the cover 300 may further comprise a third convex ring 360, a fourth convex ring 370 and a second metallic connector 380. The third convex ring 360 is corresponding to the third recess 150 of the first base 100 while the fourth convex ring 370 is corresponding to the fourth recess 250 of the second base 200. The second metallic connector 380 may be operable to electrically connect the third conductor 160 with the fourth conductor 260. When the cover 300 covers and engages with the first and second bases 100, 200, the third and fourth convex rings 360, 370 respectively engage with the third and fourth recesses 150, 250, and forming two enclosed spaces. The feature of the second metallic connector 380 may be the same as the first metallic connector 340. In particular, the second metallic connector 380 may be embodied in the cover 300 and has a third and a fourth terminal protruding from the bottom surface 312, wherein the third and fourth terminals are respectively positioned in the third and fourth convex ring 360, 370. The third conductor 160 of the first base 100 may be electrically connected to the fourth conductor 260 of the second base 200 through the second metallic connector 380.

In still another embodiment, the cover 300 further comprises a connection part 390 extending downwards from two opposite sides of the body 310, as depicted in FIG. 2. The connection part 390 is operable to connect the first and second bases 100, 200. In one example, the connection part 390 comprises a first tenon 391 and a second tenon 392. Moreover, the first base 100 has a mortice 171 corresponding to the first tenon 391. Also, the second base 200 has a mortice 272 corresponding to second tenon 392. By the engagement of the tenons 391, 392 and mortices 171, 272, the cover 300, first base 100 and second base 200 may be firmly bounded together. In some examples, more tenons and mortices may be employed to bind the cover 300, first base 100 and second base 200 together.

In one example, the connection part 390 has a locating slot 393 and the first and second bases 100, 200 respectively has a first bump 181 and a second bump 282. When the first base 100 comes into contact against the second base 200, the first bump 181 and the second bump 282 get in touch with each other. When the cover 300 covers and engages with the first and second base 100, 200, both the first and second bumps 181, 282 engage within the locating slot 393.

Figure 5:
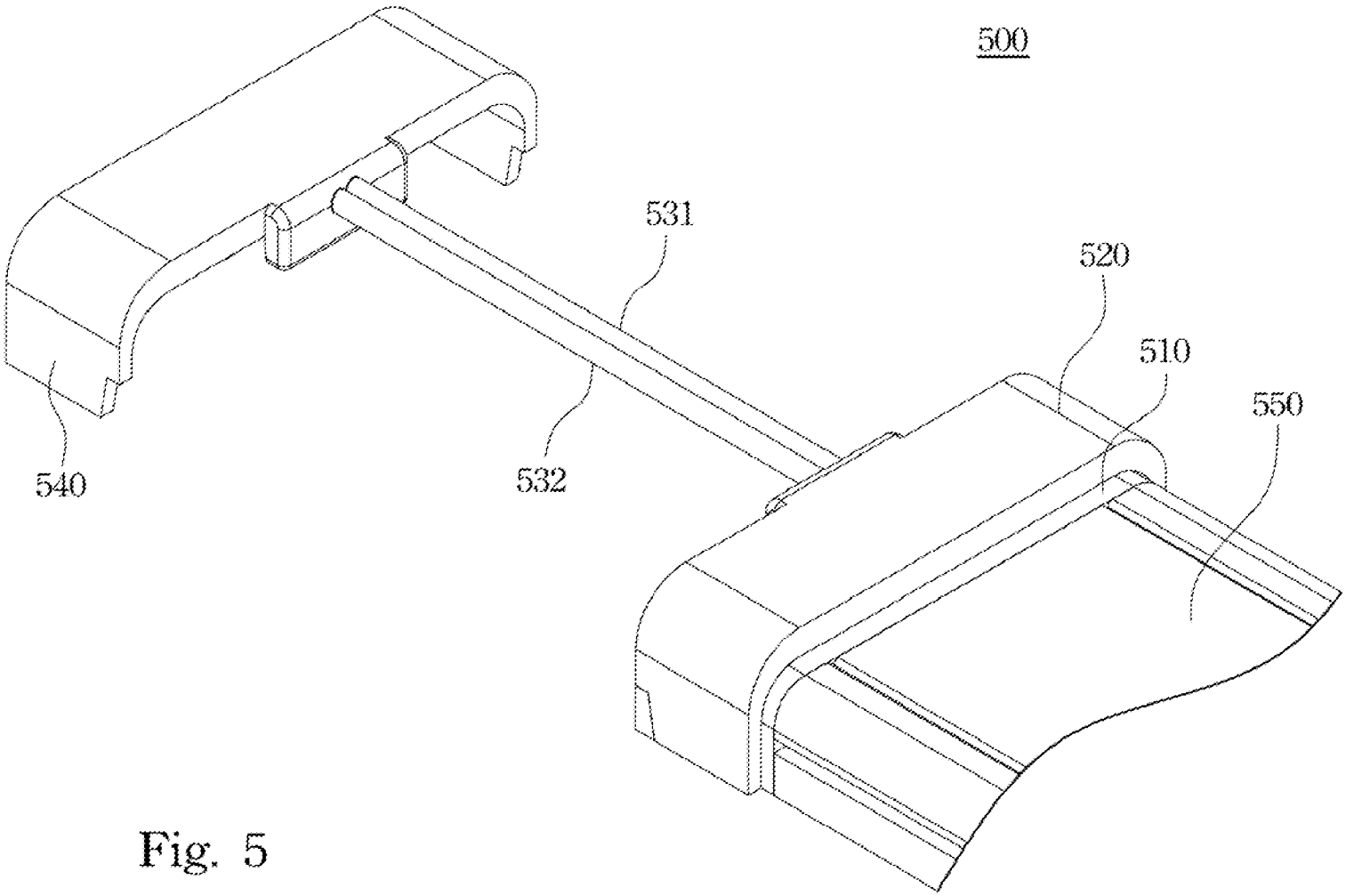
FIG. 5 is a perspective view schematically illustrating an electrical connection device according to another embodiment of the present disclosure.
Figure 6:
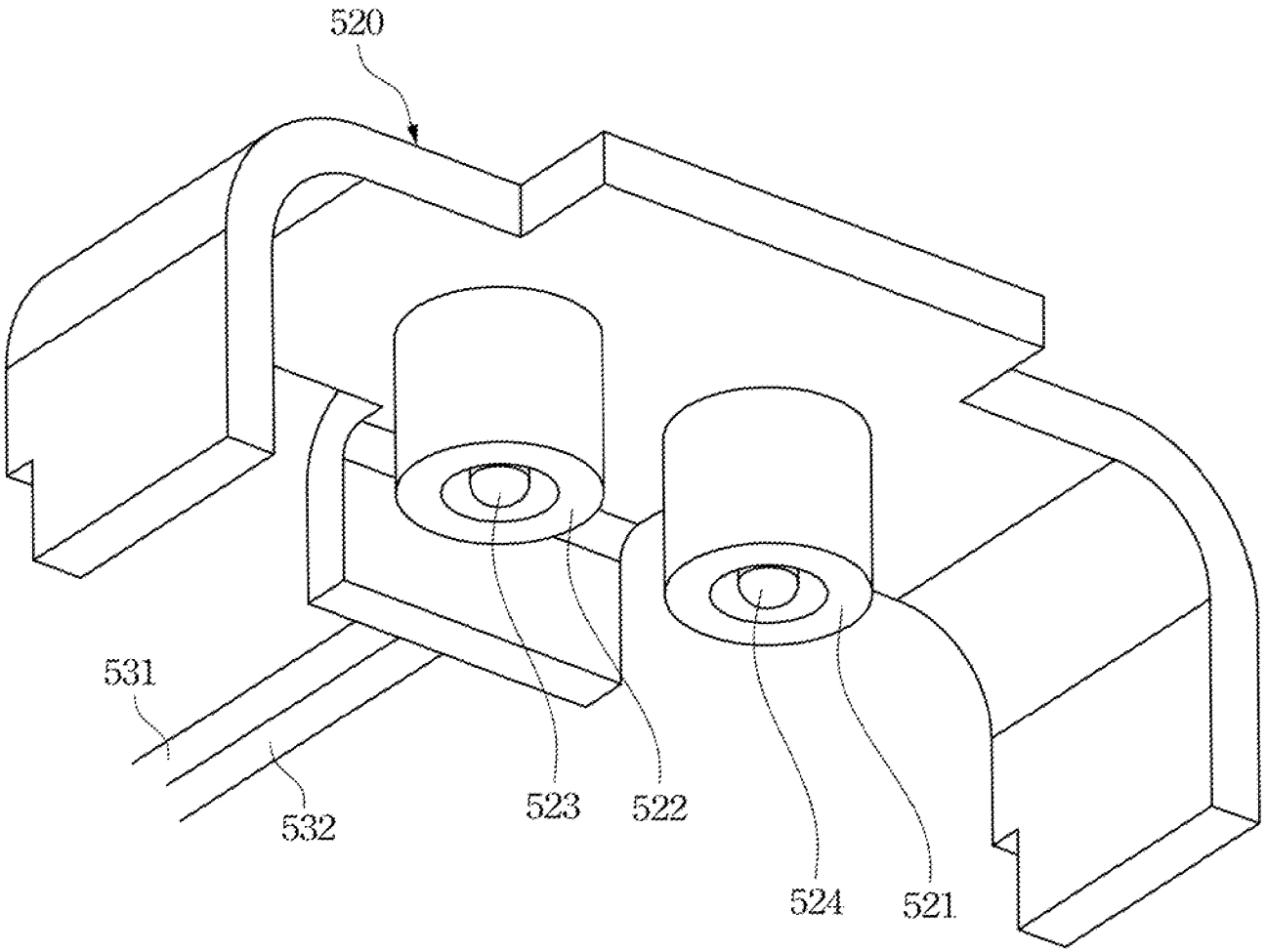
FIG. 6 is a perspective view schematically illustrating the cover according to one embodiment of the present disclosure.

In some embodiments, the electrical connection device 400 may further comprise a first sealing ring 190 and a second sealing ring 290 respectively disposed in the first recess 130 and the second recess 230, as depicted in FIG. 4. The first sealing ring 190 may enhance the airtight effect between the first convex ring 320 and the first recess 130. Also, the second sealing ring 290 may enhance the airtight effect between the second convex ring 330 and the second recess 230. In these embodiments, the electrical connection device may satisfy the International Protection Rating of IP 67 or IP 68. FIG. 5 is a perspective view schematically illustrating an electrical connection device 500 according to another embodiment of the present disclosure. The electrical connection device 500 includes a base 510, a cover 520 and two wires 531, 532. The base 510 may have the same structure as the first base 100 depicted in FIG. 2. In this embodiment, the base 510 may have two recesses (numbers 130 and 150 in FIG. 2) and two conductors (numbers 140 and 160 in FIG. 2). FIG. 6 is a perspective view schematically illustrating the cover 520 according to one embodiment of the present disclosure. As illustrated in FIG. 6, two convex rings 521, 522 are disposed on the bottom surface of the cover 520. The convex rings 521, 522 may have the same structure as the first and second convex rings 320, 330 in FIG. 3. Two metallic connectors 523, 524 are embodied in the cover 520. The constitutions of the metallic connectors 523, 524 may be substantially the same as the first and second metallic connectors 340, 380 in FIG. 3 except that the metallic connectors 523, 524 respectively are electrically connected to the wires 531, 532. The wires 531, 532 extend into the cover 520 through a lateral surface of the cover 520. When the cover 520 covers and engages with the base 510, the two conductors of the base 510 are electrically connected to the wire 531-532 through the metallic connector 523, 524 of the cover 520, respectively.

In this embodiment, the electrical connection device 500 may serve as a connector between LED light ribbons, as depicted in FIG. 5. Specifically, the two conductors (numbers 140 and 160 in FIG. 2) of the base 510 may be soldered with the electrodes of the LED light ribbon 550 so that the LED light ribbon 550 may be electrically coupled to the wires 531, 532 through the metallic connectors 523, 524 in the cover 520.

In one example, the electrical connection device 500 may further comprise another cover 540 connected to the other ends of the wires 531, 532, as depicted in FIG. 5. The cover 540 is arranged in a way that is mirror-symmetric with the cover 520. The wires 531, 532 of the electrical connection device 500 may be bended or curved, and thus the electrical connection device 500 has characteristics in bending and curving. In some examples, the other end of the wire 531, 532 may be connected to a power supply or driving means (not shown).

One skilled in the art may realize that the locations of the convex rings and recesses may be mutually exchanged, as described hereinbefore. Specifically, the convex rings may be disposed on the base while the recesses may be formed on the cover so that an enclosed space is formed between the convex ring and the recess. The airtight effect and waterproof effect may be obtained as well.

In view of the above, the electrical connection device according to the embodiments of the present disclosure may provide airtight effect and waterproof effect, and therefore prevents the water or moisture from leakage into the electrical connection device. Thereby, imperfect contacts or electrical short due to the deterioration of the metallic parts in the connector may be prevented as well. The electrical connection device disclosed herein may be employed indoors or outdoors, and is advantageous in convenient assembly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electrical connection device, comprising:

a first base, comprising:

a first top surface having a first recess;

a first lateral surface; and a first conductor extending into the first recess from a position out of the first base through the first lateral surface;

a second base, comprising:

a second top surface having a second recess;

a second lateral surface; and a second conductor extending into the second recess from a position out of the second base through the second lateral surface; and a cover for covering the first and second bases, comprising:

a body having a bottom surface;

a first convex ring located on the bottom surface;

a second convex ring located on the bottom surface and beside the first convex ring; and a first metallic connector embodied in the body and having a first and a second terminal protruding from the bottom surface, wherein the first and second terminals are respectively positioned in the first and second convex rings;

wherein when the cover covers the first and second bases, the first and second convex rings respectively engage with the first and second recesses so that a first and a second enclosed space are formed, and wherein the first and second terminals respectively connect to the first and second conductors.

2. The electrical connection device according to claim 1, wherein both the first and second convex rings are substantially circular convex rings.

3. The electrical connection device according to claim 1, wherein the cover further comprises a connection part for connecting to the first and second bases, and wherein the connection part extends downwards from two opposite sides of the body.

4. The electrical connection device according to claim 3, wherein the connection part comprises a first tenon and a second tenon for connecting to the first and second bases, respectively.

5. The electrical connection device according to claim 3, wherein the connection part has a locating slot, and the first and second bases respectively have a first and a second bump, and wherein the locating slot is capable of engaging with the first and second bumps.

6. The electrical connection device according to claim 1, further comprises a first sealing ring and a second sealing ring respectively disposed in the first and second recesses.

7. The electrical connection device according to claim 1, wherein the first base further comprises a third conductor and a third recess located beside the first recess, and wherein the third conductor extending into the third recess from a position out of the first base through the first lateral surface, and the third conductor is arranged in substantial parallel with the first conductor.

8. The electrical connection device according to claim 7, wherein the second base further comprises a fourth conductor and a fourth recess located beside the second recess, and wherein the fourth conductor extending into the fourth recess from a position out of second base through the second lateral surface, and the fourth conductor is arranged in substantial parallel with the second conductor.

9. The electrical connection device according to claim 8, wherein the cover further comprises:

a third convex ring positioned on the bottom surface beside the first convex ring and having an outer edge engaged with the third recess;

a fourth convex ring positioned on the bottom surface beside the second convex ring and having an outer edge engaged with the fourth recess; and a second metallic connector embodied in the body and having a third and a fourth terminal protruding from the bottom surface, wherein the third and fourth terminals respectively positioned in the third and fourth convex rings, wherein when the cover covers the first and second bases, the third and fourth convex rings respectively engage with the third and fourth recesses, and the third and fourth terminals respectively connect to the third and fourth conductors.

10. The electrical connection device according to claim 1, wherein the first conductor comprises a first and a second metallic piece positioned in the first recess to be connected with the first terminal of the first metallic connector.

11. An electrical connection device, comprising:

a first base, comprising:

a first top surface having a first convex ring;

a first lateral surface; and a first conductor extending into the first convex ring from a position out of the first base through the first lateral surface;

a second base, comprising:

a second top surface having a second convex ring;

a second lateral surface; and a second conductor extending into the second convex ring from a position out of the second base through the second lateral surface; and a cover for covering the first and second bases, comprising:

a body having a bottom surface;

a first recess located on the bottom surface;

a second recess located the bottom surface beside the first recess; and a first metallic connector embodied in the body and having a first and a second terminal protruding from the bottom surface, wherein the first and second terminals are respectively positioned in the first and second recesses;

wherein when the cover covers the first and second bases, the first and second convex rings respectively engage with the first and second recesses so that a first enclosed space and a second enclosed space are formed, wherein the first and second terminals respectively connect to the first and second conductors.

12. The electrical connection device according to claim 11, wherein both the first and second convex rings are substantially circular convex rings.

13. The electrical connection device according to claim 11, wherein the cover further comprises a connection part for connecting to the first and second bases, and the connection part extends downwards from two opposite sides of the body.

14. The electrical connection device according to claim 13, wherein the connection part comprises a first tenon and a second tenon for connecting to the first and second bases, respectively.

15. The electrical connection device according to claim 13, wherein the connection part has a locating slot, and the first and second bases respectively have a first and a second bump, and wherein the locating slot is capable of engaging with the first and second bumps.

16. The electrical connection device according to claim 11, further comprises a first sealing ring and a second sealing ring respectively disposed in the first and second recesses.

17. The electrical connection device according to claim 11, wherein the first conductor comprises a first and a second metallic piece positioned in the first convex ring to be connected with the first terminal of the first metallic connector.

18. An electrical connection device, comprising:

a base, comprising:

a top surface having a recess;

a lateral surface; and a conductor extending into the recess through the lateral surface from a position out of the base;

a cover, comprising:

a bottom surface having a convex ring;

a lateral surface; and a metallic connector embodied in the cover and having a first terminal protruding from the bottom surface, wherein the first terminal is positioned in the convex ring; and a wire extending into the cover through the lateral surface of the cover and electrically coupled to the metallic connector;

wherein when the cover engages with the base, the convex ring engages with the recess so that an enclosed space is formed, and the first terminal connects to the conductor.

19. An electrical connection device, comprising:

a base, comprising:

a top surface having a convex ring;

a lateral surface; and a conductor extending into the convex ring through the lateral surface from a position out of the base;

a cover, comprising:

a bottom surface having a recess;

a lateral surface; and a metallic connector embodied in the cover and having a first terminal protruding from the bottom surface, wherein the first terminal is positioned in the recess; and a wire extending into the cover through the lateral surface of the cover and electrically coupled to the metallic connector;

wherein when the cover engages with the base, the convex ring engages with the recess so that an enclosed space is formed, and the first terminal connects to the conductor.

* * * * *